United States Patent [19]

Hastings

[11] 4,224,593

[45] Sep. 23, 1980

[54] DOUBLE-MOTION THERMOSTAT

[75] Inventor: Jerome K. Hastings, Sussex, Wis.

[73] Assignee: Eaton Corporation, Cleveland, Ohio

[21] Appl. No.: 971,807

[22] Filed: Dec. 21, 1978

[51] Int. Cl.[2] ..... H01H 37/60

[52] U.S. Cl. ..... 337/334; 337/347

[58] Field of Search ..... 337/39, 57, 333–335, 337/343, 347–349, 354, 360, 361, 365, 368, 320

[56] References Cited

U.S. PATENT DOCUMENTS

| | | | |
|---|---|---|---|
| 2,195,304 | 3/1940 | Hathaway | 337/349 |
| 2,383,414 | 8/1945 | Osterheld | 337/335 |
| 2,440,025 | 4/1948 | Singleton | 337/335 |
| 2,599,473 | 6/1952 | Miller | 337/38 |
| 2,758,176 | 8/1956 | Harrold | 337/349 |
| 2,873,329 | 2/1959 | Swenson | 337/361 |
| 2,930,874 | 3/1960 | Andrews | 337/361 |
| 3,184,571 | 5/1965 | Broekhuysen | 337/335 |
| 3,236,977 | 2/1966 | Huffman | 337/354 |
| 3,378,660 | 4/1968 | Dales | 337/335 |
| 3,471,819 | 10/1969 | Gianola et al. | 337/336 |
| 3,891,957 | 6/1975 | Holtkamp | 337/347 |

FOREIGN PATENT DOCUMENTS

| | | | |
|---|---|---|---|
| 486606 | 11/1929 | Fed. Rep. of Germany | 337/361 |

*Primary Examiner*—William H. Beha, Jr.

*Attorney, Agent, or Firm*—Hugh R. Rather; Wm. A. Autio

[57] ABSTRACT

A two-bimetal thermostat provides double motion for enhanced contact actuation and minimum differential. Two bimetal plates are pivotally supported at one end to extend generally parallel. The other, deflectable ends of these bimetal plates, one of which is shorter than the other, have right-angle bends and are biased by a compression C-spring for overcenter snap-action. These deflectable ends are coupled by drive pins to respective contacts of a spring-biased contact pair to be free of the bimetal plates when closed and are actuated thereby to open condition. Differential adjustment is accomplished by adjusting one bimetal plate longitudinally to vary the C-spring load thereby to correspondingly vary the temperature differential between contact closure and opening. Range adjustment is attained by turning a knob which acts through a cam on the pivotal mounts to vary the angle between the bimetal plates thereby to require more or less bimetal bending for contact actuation.

11 Claims, 6 Drawing Figures

DOUBLE-MOTION THERMOSTAT

BACKGROUND OF THE INVENTION

Plural-bimetal thermostats have been known heretofore. However, such prior thermostats have generally been rather complex in structure and have not had all of the desirable characteristics especially useful in such devices such as increased contacts operating force, increased contacts opening distance, non-teasability of the contacts, facility of adjustment of a minimum thermal differential, means of adjustment of thermal differential in a manner that makes the repeatability and set points insensitive to contacts wear and errosion, ability to set the contacts arc gap at its optimum distance, switching to "off" that is independent of the contacts carriers, provision of contacts weld-breaking impact, as well as simplicity of construction and low cost. Consequently, it has been found desirable to design an improved thermostat providing these features.

SUMMARY OF THE INVENTION

An object of the invention is to provide an improved thermostat.

A more specific object of the invention is to provide an improved thermostat having increased contacts operating force.

Another specific object of the invention is to provide an improved thermostat having increased contacts arc gap.

Another specific object of the invention is to provide an improved two-bimetal thermostat having snap-action non-teasible contacts operating means.

Another specific object of the invention is to provide an improved bimetal thermostat having means for adjustment of the thermal differential so as to make the repeatability and set points insensitive to contacts wear and errosion.

Another specific object of the invention is to provide an improved bimetal thermostat having means for switching to "off" that is independent of the contacts carriers and provides weld-breaking impact.

Another specific object of the invention is to provide an improved thermostat structure affording adjustment thereof to a small temperature differential between contacts closing and opening.

Another specific object of the invention is to provide an improved bimetal thermostat providing temperature isolation of the bimetal members from the contacts in their "on" state.

Another object of the invention is to provide an improved bimetal thermostat of the aforementioned type that is simple in construction and low in cost.

Other objects and advantages of the invention will hereinafter appear.

DESCRIPTION OF THE PREFERRED EMBODIMENT

Figure 1:
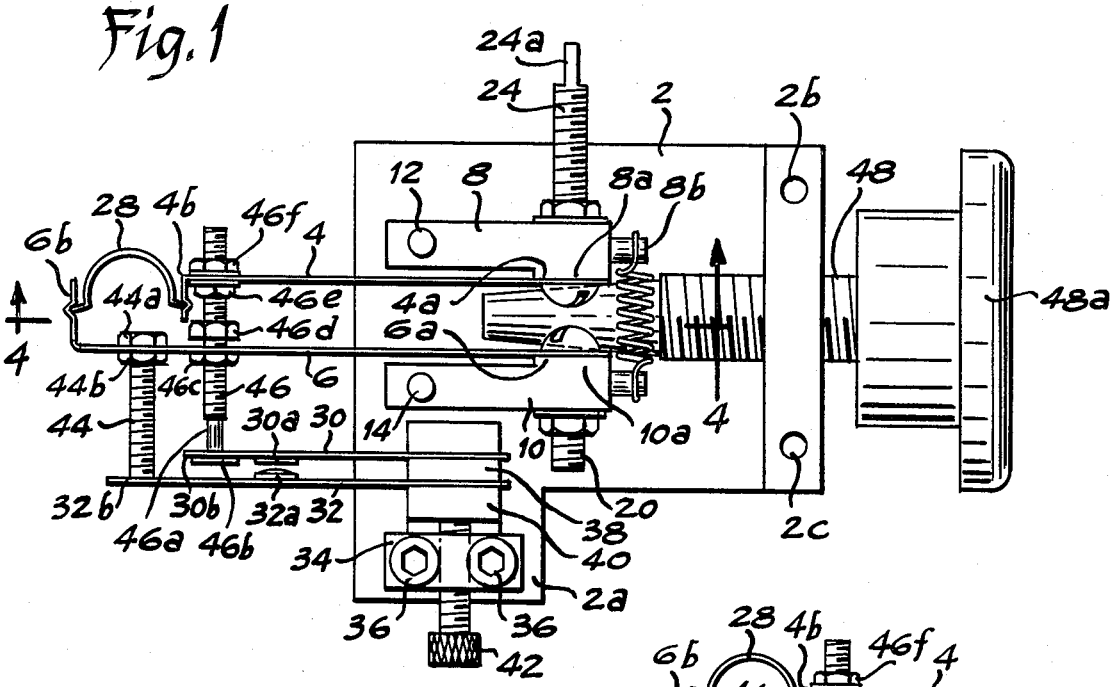
FIG. 1 is a top view of a double-motion thermostat constructed in accordance with the invention and showing the arrangement of the bimetal members and contacts.
Figure 6:
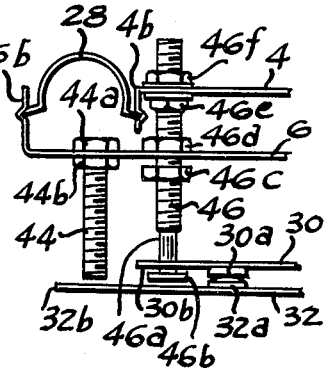
FIG. 6 is a fragmentary view of the left-hand portion of FIG. 1 showing the mechanism in the contacts-closed condition.
Figure 2:
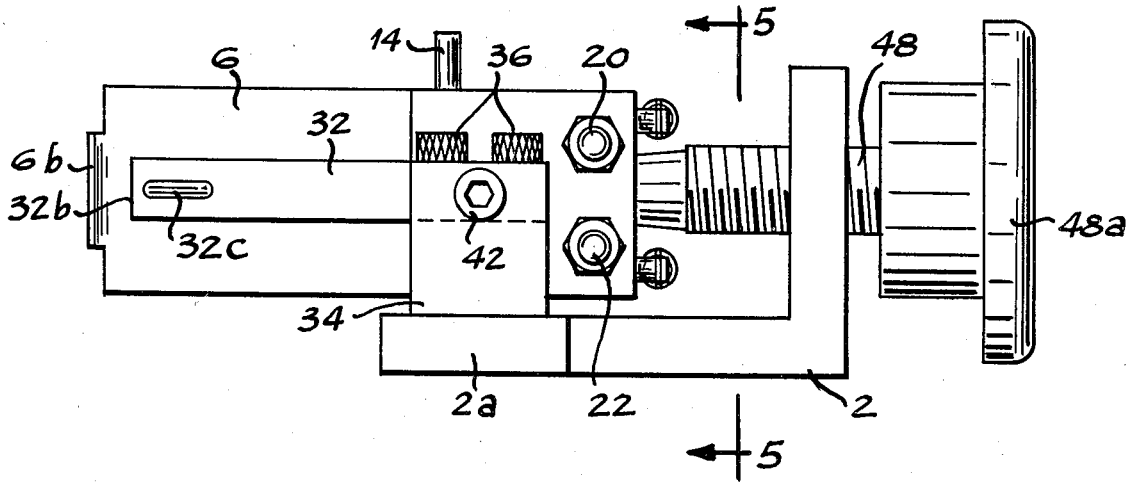
FIG. 2 is a front elevational view of the thermostat of FIG. 1 showing the range adjustment structure.

Referring to FIG. 1, there is shown a double-motion thermostat constructed in accordance with the invention, double-motion meaning that means are provided for actuating both contacts of a contact pair to close or open a circuit in response to temperature change. For simplicity of illustration, the thermostat is shown in FIGS. 1 and 2 as having a generally L-shaped base or frame 2 of electrically insulating material on which the parts are mounted. This base has substantial width as shown in FIG. 1 for supporting the bimetal members and a forward extension 2*a* on its horizontal portion for mounting the contacts hereinafter described. The vertical portion of this base is provided with a pair of spaced, vertical holes 2*b* and 2*c* therethrough for attaching a cover, housing or the like, not shown.

Figure 5:
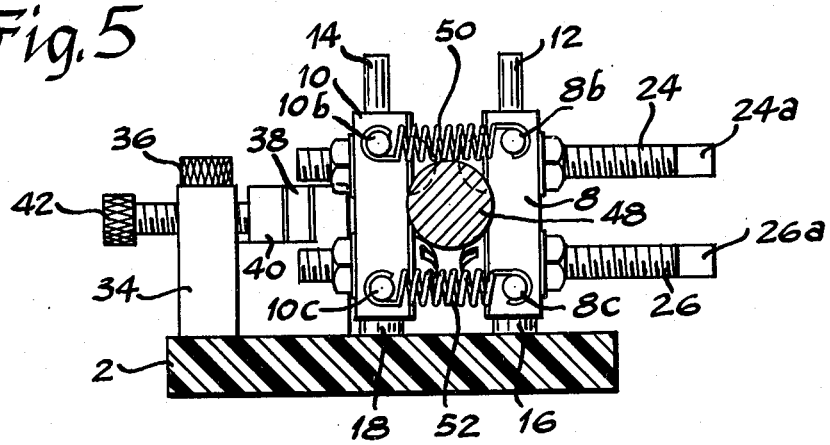
FIG. 5 is a cross-sectional view taken substantially along line 5—5 of FIG. 2 showing the bimetal mount retaining springs.

As shown in FIGS. 1 and 5, this thermostat is a twin-blade bimetal control device having two bimetal members in the form of plates or blades 4 and 6 that are coextensive at their mounted ends 4*a* and 6*a* but bimetal member 6 being longer so that its free or operating end 6*b* extends beyond the free or operating end 4*b* of the shorter bimetal member.

These bimetal members are provided with pivotal mounting means in the form of a pair of range-adjusting arms 8 and 10. These range-adjusting arms are generally rectangular plates preferably of metal and are pivotally mounted to base 2 by a pair of vertical pins 12 and 14 extending through respective holes in their left ends and attached to the base. Spacer sleeves 16 and 18 surround the respective pins beneath the lower edges of these arms to space these arms above the surface of the base as shown in FIG. 5. The upper ends of these pivot pins 12 and 14 are long enough to extend above arms 8 and 10 as shown in FIGS. 2 and 5 and may be held against spreading by abutments or by extending into holes in the aforementioned cover or housing.

Figure 3:
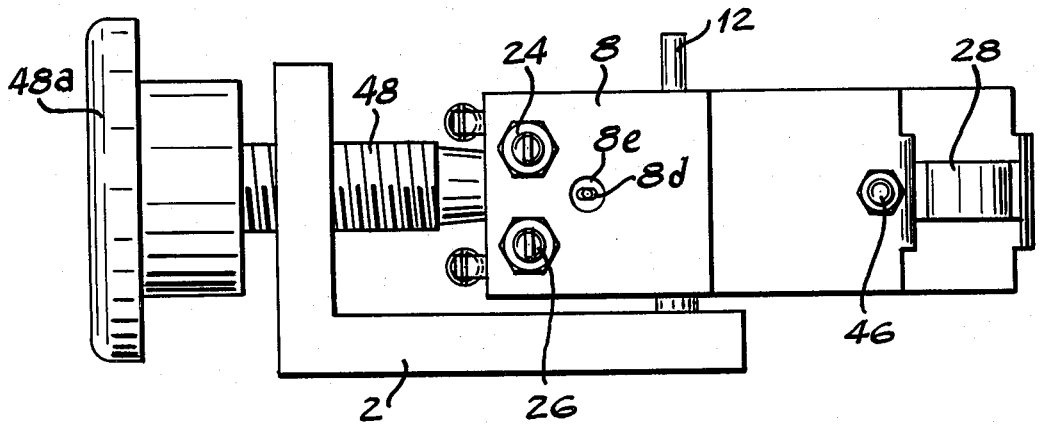
FIG. 3 is a rear view of the thermostat of FIG. 1 showing the differential adjustment access hole in the rear bimetal mount.

The right ends of arms 8 and 10 are provided with vertical, thicker portions 8*a* and 10*a* on their right-hand inner surfaces as shown in FIG. 1 providing seats for the mounted ends of the bimetal members. A pair of screws or bolts 20 and 22 shown in FIGS. 1 and 2 extend through holes in the right end portion of bimetal member 6 and thicker portion 10*a* of arm 10 to rigidly secure the bimetal member to the pivotal arm so as to extend freely generally toward the left in a vertical plane. A pair of longer screws or bolts 24 and 26 shown in FIGS. 1 and 3 extend through holes in the right end portion of bimetal member 4 and thicker portion 8*a* of arm 8 to rigidly secure this bimetal member to its supporting arm so as to extend freely toward the left generally in a vertical plane. The mounting holes in bimetal member 4 are horizontally elongated or oblong to afford adjustment of bimetal member 4 left or right relative to bimetal member 6 thereby to adjust the temperature differential as hereinafter more fully described.

Figure 4:
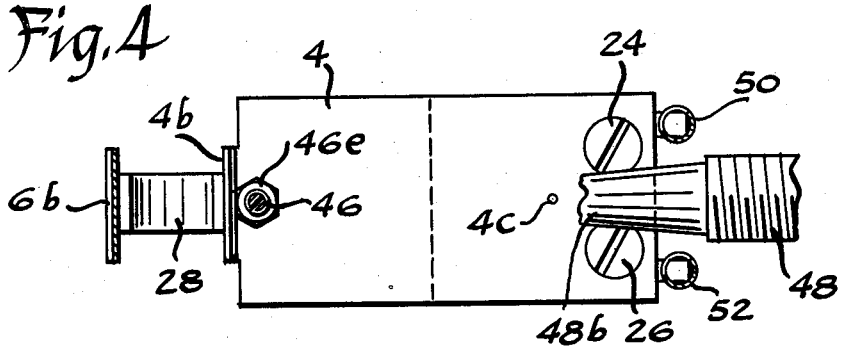
FIG. 4 is a cross-sectional view taken substantially along line 4—4 of FIG. 1 showing the differential adjustment hole in the rear bimetal member.

These bimetal members are provided with snap-action means in the form of a C-spring 28. To provide a seat for one end of this C-spring, the free end portion 4*b* of bimetal member 4 is narrower and is bent forwardly toward bimetal member 6 at substantially a right angle. Also, a sharp vertical groove is formed on the left-hand surface of this bent-over end portion 4*b* for retaining the tip of one end of the C-spring. To provide a seat for the other end of this C-spring, the free end portion 6*b* of bimetal member 6 is likewise narrower and is bent rearwardly, as shown in FIG. 1 into suitably spaced apart and laterally overlapping, generally parallel relation with bent-over end portion 4*b*, this bend also being at substantially a right angle with respect to the remainder of bimetal member 6. Also a similar sharp vertical groove is formed on the right-hand surface of this bent-over end portion 6*b* for retaining the tip of the other end of the C-spring. As shown in FIGS. 1 and 4, this C-spring is an elongated strip of metal formed into a loop and having its end portions bent sharply outwardly about 90 degrees so that they extend substantially right and left as shown in FIG. 1 for retention in the grooves in the two bimetal members. When so assembled, this C-spring is in compression so that whenever the bimetal members flex or bend overcenter under temperature change, these bimetal members will be driven further overcenter with snap action by the C-spring.

A pair of contact blades 30 and 32 are mounted on forward extension 2*a* of the base as shown in FIGS. 1 and 5. For this purpose, an insulating block 34 is mounted on the base by a pair of screws 36 extending down through its laterally wider forward part. The narrower part of this block has a U-shaped slot 34*a* at its top immediately behind such wider forward part. To secure the contact blades in this slot, the right end of contact blade 30 is placed against the rear wall of this slot, an insulating block 38 is placed against that contact blade, the right end of contact blade 32 is placed against block 38, another insulating block 40 is placed against the latter contact blade, and a screw 42 is threaded through a horizontal hole between mounting screws 36 and is turned in to clamp the two contact blades and intervening blocks tightly in place.

Contact blades 30 and 32 are provided with contact elements 30*a* and 32*a* facing one another between the two blades and these blades are provided with inherent bias so that in their released state the contact elements will be closed into engagement with sufficient contact pressure for a good electrical connection.

This thermostat is provided with means for driving the contacts open under the action of the two bimetal members. This means comprises driving pins 44 and 46 and different length driven end portions on the contact blades. As shown in FIG. 1, driven end portion 32*b* of contact blade 32 is longer than driven end portion 30*a* so that driving pin 44 can extend past the end of the latter into abutting engagement with driven end portion 32*b*. A groove 32*c* is formed on end portion 32*b* as shown in FIG. 2 to stiffen the same. This driving pin 44 is a small, fully-threaded bolt or the like. It is inserted through a hole in bimetal member 6 all the way to its head 44*a* and a mounting nut 44*b* is turned tight against the other surface of the bimetal member to rigidly secure this driving pin to the bimetal member.

The other driving pin 46 is also a headed bolt or the like having a shank that is threaded through most of its length but having a short, smooth, reduced cross-section portion 46*a* between its head 46*b* and the thread as shown in FIG. 1. This driving pin is inserted freely through a hole in the driven end portion 30*b* of contact blade 30, which hole is larger than the threaded portion of the driving pin but smaller than head 46*b* thereof. Thus, reduced cross-section portion 46*a* will not touch the edges of such hole and contact blade 30 will be completely free of this driving pin when the contacts are closed as hereinafter more fully described. A first limit stop nut 46*c* is threaded onto pin 46, the pin is inserted through a hole freely in bimetal member 6, and a second limit stop nut 46*d* is threaded onto pin 46 in suitably spaced-apart relation to bimetal member 6 as shown in FIG. 1 to limit the motions in both directions as hereinafter more fully described. A first mounting nut 46*e* is next threaded onto pin 46, the end of the pin is inserted through a mounting hole in bimetal member 4, and a second mounting nut 46*f* is threaded tight against the rear surface of bimetal member 4 to rigidly secure driving pin 46 to bimetal member 4. Suitable lock washers may be employed under the mounting nuts on both driving pins to secure them tightly in place. Alternatively, welded pins or the like may be used to provide the linkage between the moving bimetal members and the driven contacts.

The thermostat is provided with temperature range adjustment means for selecting the temperature level at which the contacts operate. This means comprises a shaft 48 threaded through the vertical portion of base 2, having a knob 48*a* secured to its external end for manual turning, and having a tapered or frusto-conical portion 48*b* at its other end that extends between range arms 8 and 10 as shown in FIGS. 1 and 4. The right-hand ends of range arms 8 and 10 are resiliently biased against tapered portion 48*b*. For this purpose, the right-hand ends of these range arms are provided with pairs of lugs 8*b–c* and 10*b–c*. Upper lugs 8*b* and 10*b* are biased toward one another by a tension spring 50 and lower lugs 8*c* and 10*c* are similarly biased toward one another by a similar tension spring 52 as shown in FIG. 5. It will, therefore, be seen that when the range adjusting shaft is turned in, arms 8 and 10 will be spread farther apart by the tapered portion against the forces of the tension springs as arms 8 and 10 slowly pivot on mounting pins 12 and 14. When this range adjusting shaft is turned out, the tapered portion thereof will allow tension springs 50 and 52 to move arms 8 and 10 toward one another at their right-hand ends. How these adjustments will vary the range of temperature at which the thermostat operates will be described in connection with the following description of operation.

This thermostat is also provided with means for adjusting the temperature differential. This means comprises a horizontally elongated small hole 8*d* in range arm 8 shown in FIG. 3 extending through this arm from an outer countersink 8*e*. Also, in alignment with such elongated hole 8*d* is a small round hole 4*c* in bimetal member 4 shown in FIG. 4. To allow the nuts on bimetal mounting bolts 24 and 26 to be loosened and tightened, these bolts are provided with flat portions 24*a* and 26*a* at their external ends for gripping with a wrench when the nuts are turned. The temperature differential between contact closing and opening is adjusted by adjusting the compression of C-spring 28. For this purpose, the nuts on bimetal mounting bolts 24 and 26 are loosened enough to allow lateral sliding of bimetal member 4. Then an adjusting tool in the form of a pin is inserted through elongated hole 8*d* into hole 4*c* in bimetal member 4 and the tool is pried against either end of hole 8*d* to slide this bimetal member toward the left in FIG. 1 to increase the loading of the C-spring or toward the right to decrease the C-spring loading. When the proper loading is arrived at, the nuts on bolts 24 and 26 are again tightened. Increasing the C-spring loading causes the differential to become larger and decreasing such C-spring loading reduced such temperature differential. This differential is adjusted by the thermostat manufacturer whereas the range may be adjusted by the user. Alternatively, a customer (user) differential adjustment can be readily provided by simply introducing a rotatable cam on one bimetal member to cause lateral movement thereof upon manual rotation of the cam.

For temperature range adjustment, knob 48*a* is turned. This adjustment changes the angle of the fixed ends, or right-hand ends in FIG. 1, of the bimetal strips and at the same time moves the free ends, or left-hand ends in FIG. 1, of these bimetal members either closer together or farther apart depending upon whether the range shaft is turned in or out. The principle here is the equal rotation of the mounting arms. This can be done as shown or by one eccentric cam rotated against the bimetal members. For example, let it be assumed that this thermostat is applied to air conditioning use. The differential, that is, the difference in temperature at which the contacts close and reopen, is adjusted by sliding bimetal member 4 as hereinbefore described to change the loading on the C-spring. If the loading is reduced, the differential is reduced. And if the loading is increased, the differential is increased. The differential may be adjusted from as small as 3 degrees F. to 7 degrees F. or 5 to 15 degrees F. or 10 to 30 degrees F. depending upon the bimetal type and C-spring gradient. It is easy to make the differential wide and high but it is difficult to make it low and narrow. For example, if the differential is set at 3 degrees F., the contacts would close to turn on the air conditioner when the temperature rises to 73 degrees F. and would reopen when the temperature falls to 70 degrees F.

The operating range of this thermostat may be adjusted between 60 degrees and 90 degrees F. by turning knob 48*a*, this range being a function of cam eccentricity and bimetal type.

The bimetal members are shown in FIG. 1 in their cool state. The contact blades are inherently biased so that they will close if released by the driving pins. In the state shown, driving pin 44 presses on contact 32 while driving pin 46 lifts contact 30 to keep the contacts open. The separation of the bimetal members under the force of the C-spring is limited by stop nut 46*c* bearing against bimetal member 6.

When the temperature rises, the bimetal members try to bend or deflect toward one another but are held by the C-spring force. The use of two bimetal members in this manner provides twice the volume of active bimetal material and consequently twice the active force or distance for actuating electrical contacts. The force of the C-spring holds the two bimetal elements in the static state shown in FIG. 1 until the forces of the bimetal elements under temperature rise reach or exceed the holding force of the C-spring. At the point where the bimetal forces overpower the C-spring force, the system becomes meta-stable and any further thermal change results in an avalanche of movement and the system snaps overcenter to the contacts closed condition. Under this condition, the end of driving pin 44 moves free of contact 32 and the head of driving pin 46 moves free of contact 30 to allow the contacts to close under their own bias. This avalanche of movement of the bimetal elements is limited by stop nut 46*d* bearing against bimetal member 6. Because this is a force balance system, it is not teasible. The action is swift and unstoppable due to the avalanche of force vectors.

Thermal differential is adjusted by changing the C-spring load, not by changing the contacts arc gap. This feature makes the repeatability and set points insensitive to contact wear and errosion. It also allows the contacts arc gap to be set at its optimum distance. A larger contacts arc gap can be achieved by this arrangement wherein the contact carriers are cantilever members, each linked to a separate bimetal member. This results in motion of both contacts but in opposite directions.

Total energy usage is accomplished by the build-up of force in the bimetal elements until trip, transfer of the energy of the bimetal elements to the C-spring during one-half of the trip cycle, and transfer of the energy from the C-spring back to the bimetal elements during the last half of the trip cycle. This shuttling of energy between the bimetal elements and the C-spring allows the system to operate under higher forces. The thermal input to the bimetal elements acts as a trigger to release the energy that is then transferred as aforesaid.

During each switch cycle, there is some energy lost in the movement of the contact carriers. This energy is less than or equal to the input due to the thermal change. Prior to each switch cycle, there is an increase in energy in relation to the thermal change. The system cannot start to switch until there is enough energy to complete the cycle. The result is a non-teasible, stall-proof system. Because moving friction is typically less than static friction, the system will always have enough power to keep moving if it has enough power to start moving.

The thermal sensing members are physically not connected to the switching contacts when the thermostat is in the "on" mode. Heat from the contacts during the "on" state is not transferred to the bimetal members because they are isolated by air from the contacts. This provides for good repeatability (no external heat source). This results in a switch to "off" that is independent of the contact carriers. It also provides for a weld-breaking mechanism due to the impact of the transfer or driving pins 44 and 46 on the contact carriers. Since the air gap between the driving pins and contact carriers isolate the thermal sensor from the switch, the overcenter snap action is under way and the system velocity is developed prior to contact with the electric switch. This rapid change in velocity produces impact to break any contact welds that might have occurred on the previous closure thus insuring reliable performance.

While the two bimetal members and contacts have been described as closing the contacts upon temperature rise, it will be apparent that they could readily be arranged to open normally-closed contacts on temperature rise if desired. In either case, the double-motion attained by use of two bimetal members, each actuating a movable contact of a contact pair, provides for greater current interruption.

Also, while range adjusting knob 48*a* is shown at the right-hand end in FIG. 1, it will be apparent that a side knob could be used by forming a pair of cams on range arms 8 and 10 facing one another and driving a cam follower by a toothed rotary shaft extending in from the side knob, this being a variation of the range adjusting means shown.

While the apparatus hereinbefore described is effectively adapted to fulfill the objects stated, it is to be understood that the invention is not intended to be confined to the particular preferred embodiment of double-motion thermostat disclosed, inasmuch as it is susceptible of various modifications without departing from the scope of the appended claims.

I claim:

1. A double-motion thermostat comprising:
a pair of bimetal members;
means mounting said bimetal members at first portions thereof such that other, active portions thereof move in opposite directions in response to temperature change;
overcenter snap-action means coupled between said active portions of said bimetal members for tripping at a predetermined temperature level to drive said active portions still farther in said opposite directions;
a pair of electrical contacts; and
driving means coupling said active portions of said bimetal members to the respective contacts of said pair of electrical contacts.

2. The double-motion thermostat claimed in claim 1, wherein:
said means mounting said bimetal members comprises:
range adjusting means for varying the orientation of said bimetal members relative to one another thereby to adjust the temperature range at which said contacts operate.

3. The double-motion thermostat claimed in claim 1, wherein:
said means mounting said bimetal members comprises:
a pair of pivotal mounts for supporting said bimetal members generally parallel to one another but allowing variation of the angle therebetween;
means resiliently biasing said pivotal mounts tending to change the magnitude of said angle; and
range adjusting means for adjusting said angle between said bimetal members against the force of said biasing means to adjust the temperature range of the thermostat.

4. The double-motion thermostat claimed in claim 3, wherein:
said overcenter snap-action means comprises:
angularly bent portions at said active portions of said bimetal members with said bent portions being space apart and generally parallel; and
compression spring means between said angularly bent portions providing overcenter snap-action at said predetermined temperature level; and
said means mounting said bimetal members also comprises:
means for adjusting one of said bimetal members on its pivotal mount relative to the other bimetal member to vary the loading of said compression spring means thereby to adjust the temperature differential between contacts closing and contacts reopening.

5. The double-motion thermostat claimed in claim 1, wherein:
said overcenter snap-action means comprises:
a compression spring between said active portions of said bimetal members for accelerating the movement thereof at said predetermined temperature level still further in said opposite directions to actuate said contacts.

6. The double-motion thermostat claimed in claim 1, wherein:
said overcenter snap-action means comprises:
right-angle bent portions at said active end portions of said bimetal members with said bent portions being space apart and substantially parallel; and
a C-spring in compression between said bent portions providing overcenter snap-action at said predetermined temperature level.

7. A double-motion thermostat comprising:
supporting means;
a pair of bimetal members;
means on said supporting means mounting said bimetal members at first end portions thereof so that the other, active end portions thereof move in response to temperature change;
overcenter tripping means coupled to said active end portions of said bimetal members for accelerated movement at a predetermined temperature level to drive said active end portions to a limit of movement;
electrical contacts mounted on said supporting means; and
driving means coupling said active end portions of said bimetal members to said electrical contacts to control the latter in response to temperature changes.

8. The double-motion thermostat claimed in claim 7, wherein:
said electrical contacts comprise a pair of contacts spring-biased to close when released by said driving means; and
said driving means comprises a pair of drive members coupling said bimetal members to the respective contacts to reopen the latter.

9. The double-motion thermostat claimed in claim 8, wherein:
said pair of drive members comprise a pushing pin coupling one of said bimetal members to one of said contacts and a pulling pin coupling the other bimetal member to the other contact; and
said bimetal members are arranged so that their active end portions move in opposite directions in response to temperature change thereby to release said contacts to allow them to close upon temperature rise to said predetermined level and to push and pull the respective contacts open upon temperature decrease to another level.

10. The double-motion thermostat claimed in claim 9, wherein:
one of said drive members coupled to one of said bimetal members includes limit stop means acting on the other bimetal member to stop the movement of said active end portions of said bimetal members at said limit of movement.

11. The double-motion thermostat claimed in claim 8, wherein:
said drive members and said bimetal members are thermally isolated from said contacts in their closed state.

* * * * *